US006232951B1

(12) United States Patent
Miyamoto

(10) Patent No.: US 6,232,951 B1
(45) **Date of Patent: *May 15, 2001**

(54) DISPLAY SYSTEM WHICH DISPLAYS AN IMAGE REGARDING VIDEO DATA IN A PLURALITY OF DIFFERENT TYPES OF DISPLAY MODES

(75) Inventor: Katsuhiro Miyamoto, Isehara (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/742,051

(22) Filed: Nov. 1, 1996

(30) Foreign Application Priority Data

Nov. 8, 1995 (JP) ..... 7-289791

(51) Int. Cl.[7] ..... G09G 5/00
(52) U.S. Cl. ..... 345/132
(58) Field of Search ..... 345/132, 3, 127, 345/131, 149, 202, 517, 193, 515

(56) References Cited

U.S. PATENT DOCUMENTS

| | | | | |
|---|---|---|---|---|
| 4,979,738 | * | 12/1990 | Frederiksen | 345/132 |
| 5,189,401 | * | 2/1993 | Kugler et al. | 345/132 |
| 5,473,342 | * | 12/1995 | Tse et al. | 345/132 |
| 5,500,654 | * | 3/1996 | Fujimoto | 345/132 |
| 5,550,586 | * | 8/1996 | Kudo et al. | 348/222 |
| 5,903,253 | * | 5/1999 | Mizutome et al. | 345/149 |

* cited by examiner

*Primary Examiner*—Chanh Nguyen
(74) *Attorney, Agent, or Firm*—Fitzpatrick, Cella, Harper & Scinto

(57) ABSTRACT

A video data processor is used in a system which displays an image regarding video data in a plurality of different display modes. The video data processor includes a first generator which generates the video data, and a second generator which generates mode data which is different from the video data and which indicates a display mode of the image regarding the video data generated by the first generator. Also included is a transmitter which transmits the video data generated by the first generator and the mode data generated by the second generator, with the video processor converting an image regarding the video data into data of a form suitable for display according to the transmitted mode data.

26 Claims, 7 Drawing Sheets

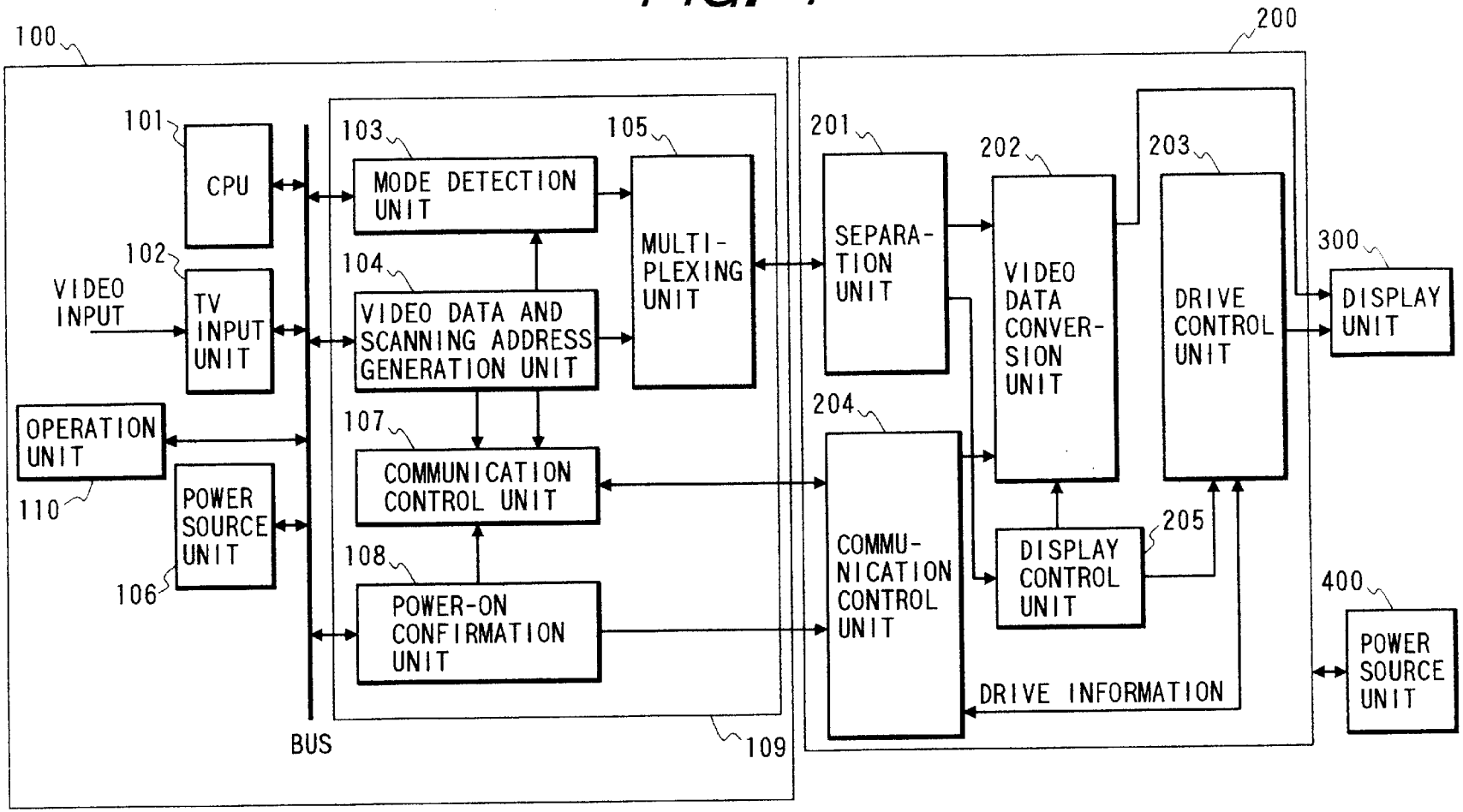
FIG. 1
100
101
CPU
102
TV INPUT UNIT
VIDEO INPUT
OPERATION UNIT
110
POWER SOURCE UNIT
106
BUS
103
MODE DETECTION UNIT
104
VIDEO DATA AND SCANNING ADDRESS GENERATION UNIT
107
COMMUNICATION CONTROL UNIT
108
POWER-ON CONFIRMATION UNIT
105
MULTI-PLEXING UNIT
109
200
201
SEPARA-TION UNIT
202
VIDEO DATA CONVER-SION UNIT
203
DRIVE CONTROL UNIT
204
COMMU-NICATION CONTROL UNIT
205
DISPLAY CONTROL UNIT
DRIVE INFORMATION
300
DISPLAY UNIT
400
POWER SOURCE UNIT

DISPLAY SYSTEM WHICH DISPLAYS AN IMAGE REGARDING VIDEO DATA IN A PLURALITY OF DIFFERENT TYPES OF DISPLAY MODES

BACKGROUND OF THE INVENTION

1. Field of the Invention

The invention relates to a display system and, more particularly, to a system which can deal with various display modes.

2, Related Background Art

In recent years, in a computer system, as a display graphic card for displaying an image from a computer to a monitor, graphic cards having various display modes (for example, resolutions in the horizontal and vertical directions, the number of display colors) have been proposed. It is also required that a display for receiving video signals from those graphic cards through a display controller and displaying them can deal with various display modes.

However, a conventional system among the graphic card, display controller, and display has the following problems.

(1) A resolution and the number of display colors of the display cannot be rapidly switched in accordance with changes in resolutions and numbers of display colors in the horizontal and vertical directions of video data which is sent from the graphic card.

For example, a CRT display called a multiscan recognizes changes in resolutions in the horizontal and vertical directions of the input video data by respectively detecting periods and polarities of horizontal and vertical sync signals in the video data, thereby changing a resolution on the display side on the basis of information of the recognition result. According to such a method, it takes a certain amount of time to confirm the periods of the horizontal and vertical sync signals and the display mode cannot be rapidly switched.

(2) The number of colors of the video data sent from the graphic card side cannot be recognized. An accurate resolution cannot be recognized as well (this is because a dot clock synchronized with a sampling frequency of the video data is not obtained).

(3) When it is necessary to change driving conditions of the display in a real-time manner from the graphic card side, such information cannot be transmitted and processed between the conventional graphic card and the display.

For example, in the display of a matrix construction, such necessity is useful in case of performing a control in a manner such that when a driving period has to be raised in accordance with the number of scanning lines of the video data which is supplied from the graphic card side, information such as the number of scanning lines is received from the graphic card side and, in order to raise the driving period in accordance with such information, a driving voltage or the like is raised.

(4) When the number of valid bits in a data bus for transmitting the video signal, namely, the number of valid bits in the data bus of a plurality of bits connected in parallel and a bit construction (bits/pixel) per pixel differ for every graphic card, the information of the data bus and a data transmission format cannot be recognized on the display side, so that the operations cannot be performed on the display side such that only the valid data is extracted and only the video data is sorted without a gap and an image corresponding to each video data is displayed.

(5) There is no means for informing the graphic card side of the driving conditions and information from the display controller when a power source is turned on.

(6) When the graphic card side and the display and display controller side operate from different power sources, there is no means for judging a state regarding whether or not the information can be transmitted between the graphic card and the display controller.

SUMMARY OF THE INVENTION

It is an object of the invention to solve the problems as mentioned above.

Another object of the invention is that when a display mode of input video data changes, it is possible to follow such a change.

Under such objects, according to the invention, as one embodiment, there is provided a video data processing apparatus, comprising: first generating means for generating video data; second generating means for generating mode data which is different from the video data and indicates a display mode of the video data; and transmitting means for transmitting the video data generated by the first generating means and the mode data generated by the second generating means to a processing apparatus for converting an image regarding the video data into data of a form suitable to display.

Still another object of the invention is to enable a good image to be displayed in accordance with a change in display mode of video data.

Under such an object, according to the invention, as one embodiment, there is provided a system capable of displaying an image regarding video data in a plurality of different kinds of display modes, comprising: first generating means for generating the video data; second generating means for generating mode data which is different from the video data and indicates the display mode of the image regarding the video data; transmitting means for transmitting the video data generated by the first generating means and the mode data generated by the second generating means; processing means for receiving the video data and mode data transmitted by the transmitting means and processing the video data in accordance with the mode data; and display means for displaying the image regarding the video data processed by the processing means.

The above and other objects and features of the present invention will become apparent from the following detailed description and the appended claims with reference to the accompanying drawings.

BRIEF DESCRIPTION OF THE DRAWINGS

FIG. 1 is a block diagram showing an embodiment of the invention;

DETAILED DESCRIPTION OF THE PREFERRED EMBODIMENTS

Figure 2:
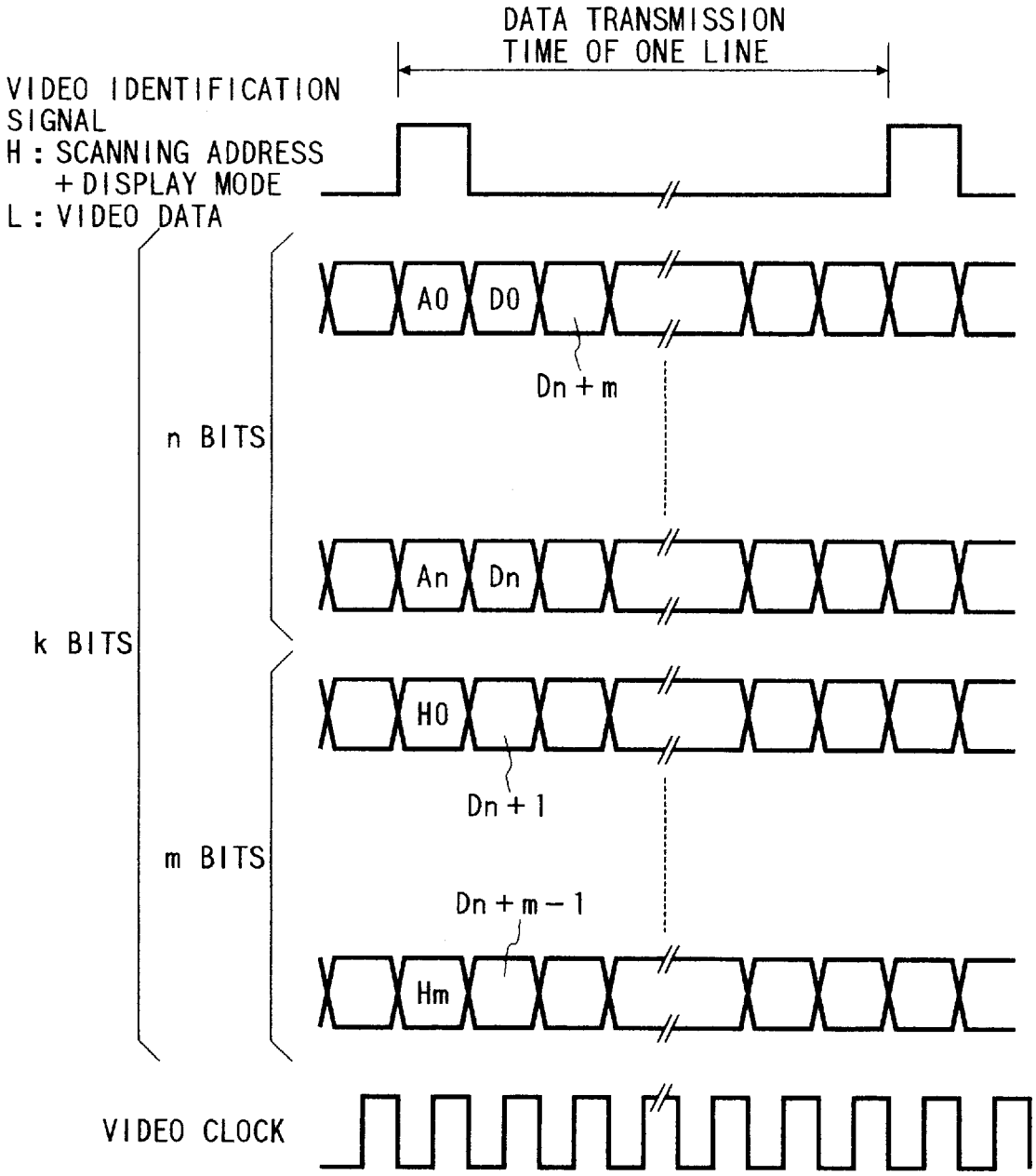
FIG. 2 is a timing chart showing a display mode transmitting operation.

FIG. 1 is a block diagram showing an embodiment of a display system according to the invention.

In the diagram, reference numeral 100 denotes a computer comprising a CPU 101, a graphic card 109, and the like; 200 a display controller for displaying an image according to video data which is outputted from being a computer 100 to a display unit 300; and 300 the display unit such as an FLCD or the like.

In the computer 100, the CPU 101 executes a control to supply the video data to the display unit 300 and also controls each unit in the computer 100. Reference numeral 102 denotes a TV input unit for receiving a video signal such as a television signal or the like under the control of the CPU 101 and converting the video signal into digital data of a form suitable for displaying by the display unit 300. In the graphic card 109, reference numeral 103 denotes a mode detection unit for forming horizontal and vertical resolutions, the number of display colors, driving conditions of the display unit 300, and mode information indicative of a data bus width, its format, and the like to transmit the data to the display unit 300. Reference numeral 104 denotes a video data and scanning address generation unit for generating the video signal of the format suitable for the display unit 300 under the control of the CPU 101 and generating scanning address data to notify of information indicating to which line position of the display unit 300 the video signal corresponds. If the scanning position where the display unit 300 displays cannot be designated, the scanning address generating function can also be omitted.

Reference numeral 105 denotes a multiplexing unit for multiplexing the data which is respectively outputted from the mode detection unit 103 and video data and scanning address generation unit 104 as will be explained hereinlater and transmitting the multiplexed data to the display controller 200. Reference numeral 106 denotes a power source unit for supplying a power source to each of the units 101 to 107; 107 being a communication control unit for performing a control to transmit the driving conditions of the display unit 300 from the video data and scanning address generation unit 104 and information such as data bus width and its format to transmit the data to the display unit 300; 108 a power-on confirmation unit for detecting whether a power source of the power source unit 106 has been turned on or not and transmitting information indicative of the detection result via a power source confirmation line; and 110 an operation unit such as keyboard, mouse, or the like for the user to perform various instructions to the computer 100. The graphic card 109 forms video data and other information and transmits and receives them to/from the display controller 200.

In the display controller 200, reference numeral 201 denotes a separation unit for identifying the display mode and scanning address information from the data transmitted from the graphic card 109 and separating them from the video data; 202 a video data conversion unit for receiving only the video data separated by the separation unit 201 and transmitting to the display unit 300 and converting the video data on the basis of the mode data detected by a display control unit 205 described hereinafter, which will be explained hereinlater; 203 a drive control unit for transmitting and receiving data regarding the driving of the display unit 300 from the display control unit 205 or a communication control unit 204, which will be explained hereinlater and changing and transmitting the driving conditions of the display unit 300; 205 the display control unit for receiving the scanning address and mode information separated by the separation unit 201, determining the optimum conditions for the video data conversion unit 202 and drive control unit 203 in accordance with the display mode information, forming information indicative of the decided optimum conditions, and supplying it to the drive control unit 203; and 204 the communication control unit for receiving the information which is sent from the communication control unit 107 and transmitting the driving conditions of the display unit 300 and the information of the data bus width and its format to transmit the data to the display unit 300. The display unit 300 includes a driving circuit to display an image regarding the video data which is controlled in the display controller 200. Reference numeral 400 denotes a power source unit of the display controller 200 and display unit 300.

The operation will now be described.

First, a method of transmitting change information of the display resolutions in the horizontal and vertical directions or the number of display colors from the graphic card 109 to the display controller 200 will be described. By an instruction from the operation unit 110, when the CPU 101 changes the display resolutions or display color from a state in which the image is at present drawn on the display unit 300 or when the video signal of the TV input unit 102 is transmitted to the display unit 300, the CPU 101 transmits the display mode information to the mode detection unit 103 through the bus in accordance with the resolutions in the horizontal and vertical directions and the display color of the video data to be changed.

The video data which is supplied through the bus is stored into a memory in the video data and scanning address generation unit 104. The video data is read out from the memory every line and a scanning address indicative of the line of the video data in the picture plane is formed. On the other hand, the mode detection unit 103 receives the information of the display mode to be changed from the CPU 101, forms the mode data in a format which can be processed by the display controller 200 on the basis of the received display mode information, multiplexes the mode data to the video signal of one line generated by the video data and scanning address generation unit 104 as will be explained hereinlater, and transmits the multiplexed signal to the display controller 200.

As shown in FIG. 2, a transmission line between the graphic card 109 and display controller 200 is constructed by a video data bus of k bits (parallel) and a line for transmitting a video clock synchronized with the video data to receive the video data by the display controller 200 and a video identification signal. Those lines are connected by a connector (not shown).

The scanning address information and display mode information are added one bit by one to the head of the video signal as shown in FIG. 2 on the video data bus of k bits and are multiplexed by the multiplexing unit 105. In the embodiment, as a multiplexing timing of the mode data to the video data, the mode data is inserted every horizontal sync blanking period. Namely, the mode data is multiplexed at a timing corresponding to the header portion of the video data just after each horizontal sync signal. In this instance, the video identification signal is formed so that the display controller 200 can identify the video data and the scanning address information and display mode information and is transmitted by an amount of one video clock at the same timing as that of the video signal.

The identification of the scanning address information and display mode information is performed in accordance with the bit allocation which has been predetermined between the graphic card 109 and display controller 200. In the example of FIG. 2, n bits among k bits are allocated to the scanning address data and m bits are allocated to the display mode data. With respect to the display unit 200 which does not need the scanning address data, all of the k bits can also be used as display mode data.

It is not always necessary to predetermine the information about the k, n, and m bits, before the video signal is transmitted, a data communication is performed each time on a serial communication line between the communication control units 107 and 204 and can also be determined.

Figure 3:
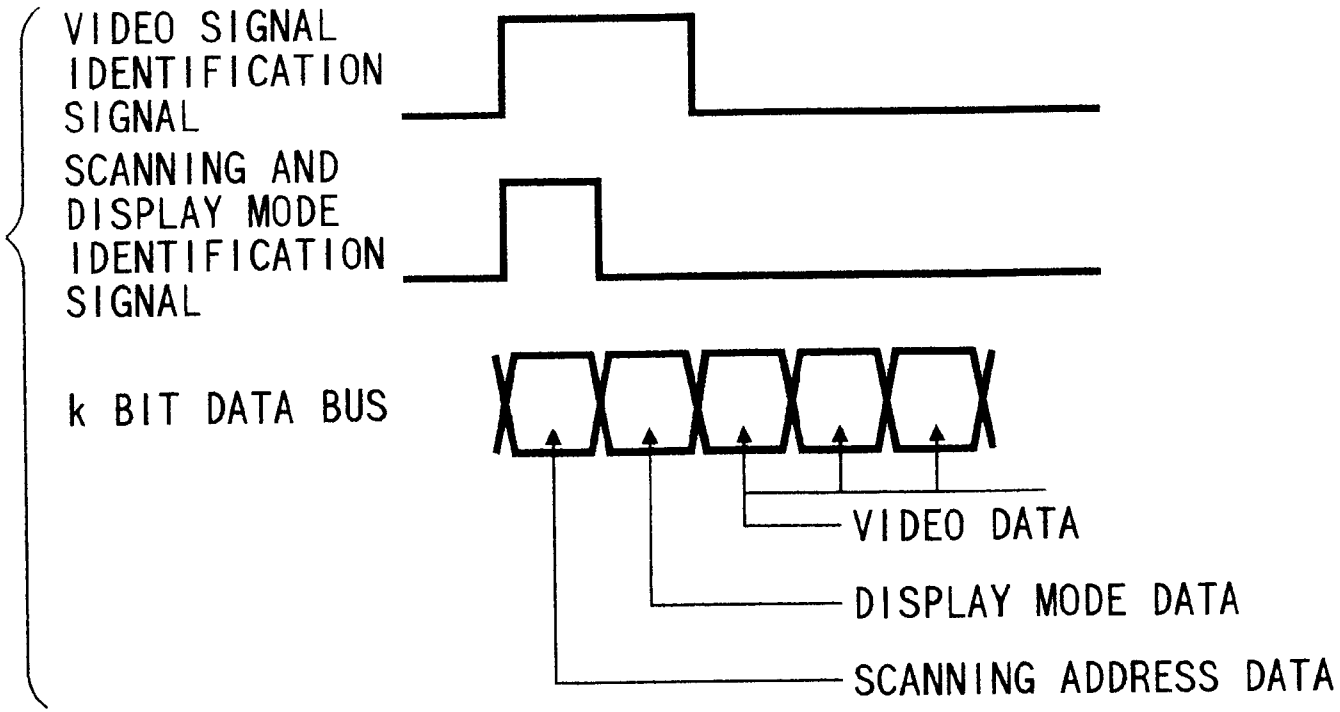
FIG. 3 is a timing chart showing another display mode transmitting operation.

Further, as shown in FIG. 3, an identification signal line to identify the display mode and the scanning address data can also be added and transmitted.

As signals which are transmitted between the multiplexing unit 105 and separation unit 201, for example, in addition to the video signal bus, video clock, video signal ID signal, scanning address, and display mode ID signal, it is also possible to newly add a horizontal sync signal indicative of a delimiter of one line or a video data request signal to successively request the video signal of one line from the display controller 200.

As mentioned above, the video signal outputted from the graphic card 109 is separated into the scanning address data, display mode data, and video data by the separation unit 201 of the display controller 200 on the basis of the video signal ID signal. The scanning address data and the display mode data are sent to the display control unit 205. The scanning address data is used here for control of the scanning address and, after that, it is supplied to the drive control unit 203 and becomes information to decide the drawing position of the video data which is sent to the display unit 300.

In accordance with the display mode data, the display control unit 205 forms data to control the driving of the display unit 300 and also controls a converting operation of the video data which is transmitted to the video data conversion unit 202.

For example, assuming that the display unit 300 has a display resolution ability of 1280 pixels in the horizontal direction, so long as the display mode data is the data indicative of a display resolution of 640 pixels in the horizontal direction, the display control unit 205 samples one pixel data twice for the video data conversion unit 202 and controls so as to double the video data in the horizontal direction.

When the received display mode is a display mode in which the number of display colors is larger than that of the display unit 300, the video data conversion unit 202 is controlled so as to interpolate the insufficient number of colors by executing a pseudo halftone process by an error diffusion or a dither method.

Figure 4:
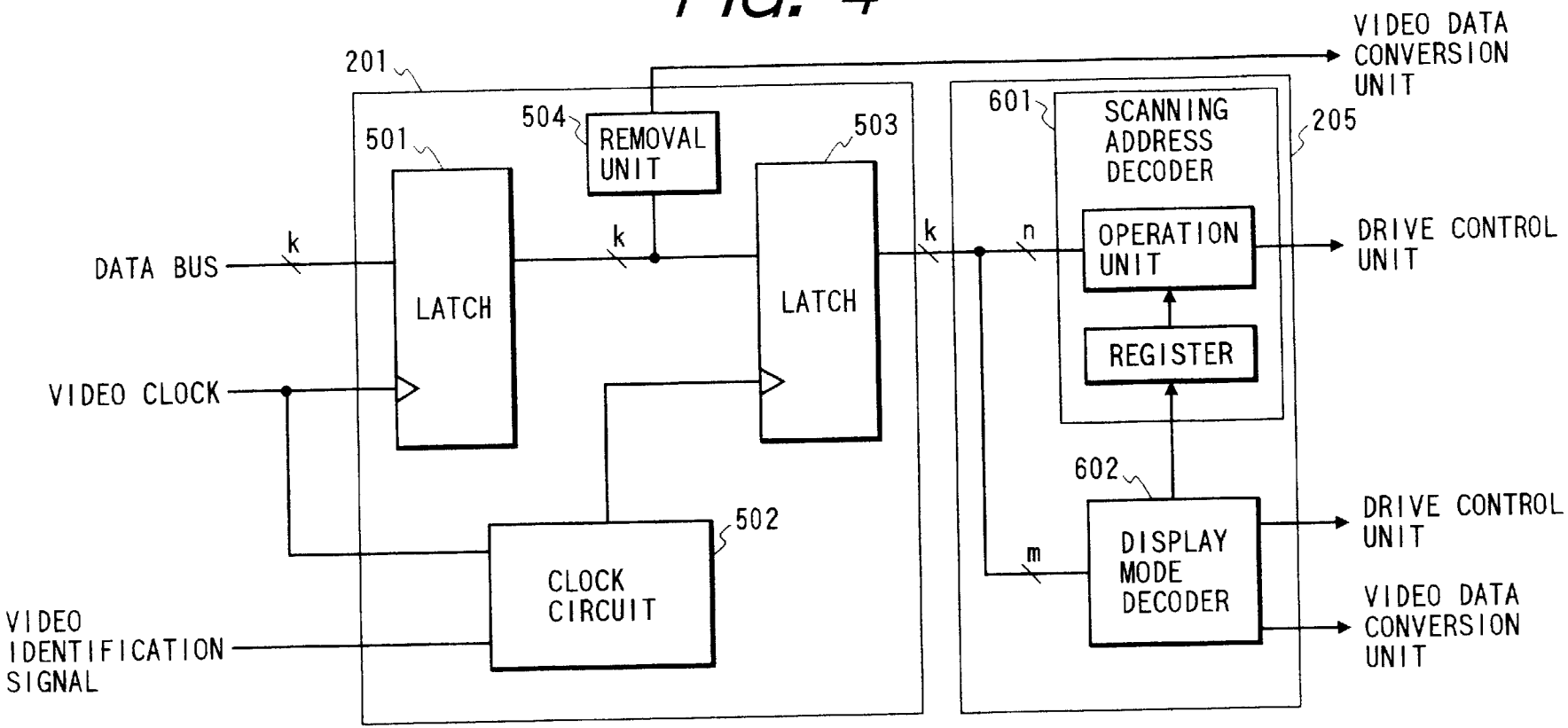
FIG. 4 is a block diagram showing another embodiment of the invention.

The separation unit 201 and display control unit 205 will now be described in detail. FIG. 4 is a block diagram of them.

In FIG. 4, the video data of a k-bit bus which is transmitted from the graphic card 109 is latched once by a latch 501 by the video clock which is transmitted synchronously with the video data. On the other hand, a clock which is set to the high level at a timing when the scanning address and the data display mode are transmitted is formed by a clock circuit 502 from a video ID signal and video clock. An output of the latch 501 is further latched into a latch 503 and only the scanning address and display mode are extracted.

n bits among k bits are inputted as a scanning address to a scanning address decoder 601. Also, bits among k bits are inputted as a display mode to a display mode decoder 602. The display mode decoder 602 decodes m bits into $2_m$ commands and outputs a control signal corresponding to a map (stored in a built-in ROM) corresponding to the decoded data which has previously been stored, to the drive control unit 203 and video data conversion unit 202.

For example, assuming that the decoded contents are contents such that a driving IC in the display unit 300 is simultaneously driven with respect to two (or four) lines, the display mode decoder performs those instructions to the drive control unit 203.

When the contents of the display mode data are contents such that the display position on the display unit 300 is moved downward, a certain value is added to the scanning address of n bits which is supplied to the scanning address decoder 601 and the scanning address is increased, thereby enabling the display position to be moved downward. Such an arithmetic operation is executed in the scanning address decoder 601. Namely, the display mode decoder 602 calculates data for controlling the display position and supplies it to a register in the scanning address decoder. An arithmetic operating unit executes an arithmetic operation by using the data in the register and the scanning address data.

When the display mode is changed to a mode in which the number of scanning lines is larger than that of the mode which is under operation at present, the display mode decoder 602 instructs a control so as to raise the driving voltage of the display unit 300 to the drive control unit 203. Such a process is effective to a display device in which a drawing speed becomes fast by raising the driving voltage.

The scanning address data and display mode data are removed from the data that is supplied from the latch 501 by a removal unit 504 and are converted into a data train composed of only the video data. After that, the data train is supplied to the video data conversion unit 202.

The video data conversion unit 202 will now be described.

The video data separated by the separation unit 201 as mentioned above is subjected to a data converting process by the video data conversion unit 202. In the video data conversion unit 202, the foregoing pseudo halftone process or a process for sampling the video data at a clock frequency that is n times as high as the video clock transmitted and increasing the number of data in the horizontal direction to n times is executed in accordance with the control data from the display control unit 205.

Further, the transmitted video data is sorted on a pixel unit basis, thereby absorbing a difference of the data format of bits/pixel and a difference of the number of valid bits in the data bus width.

Figure 5A:
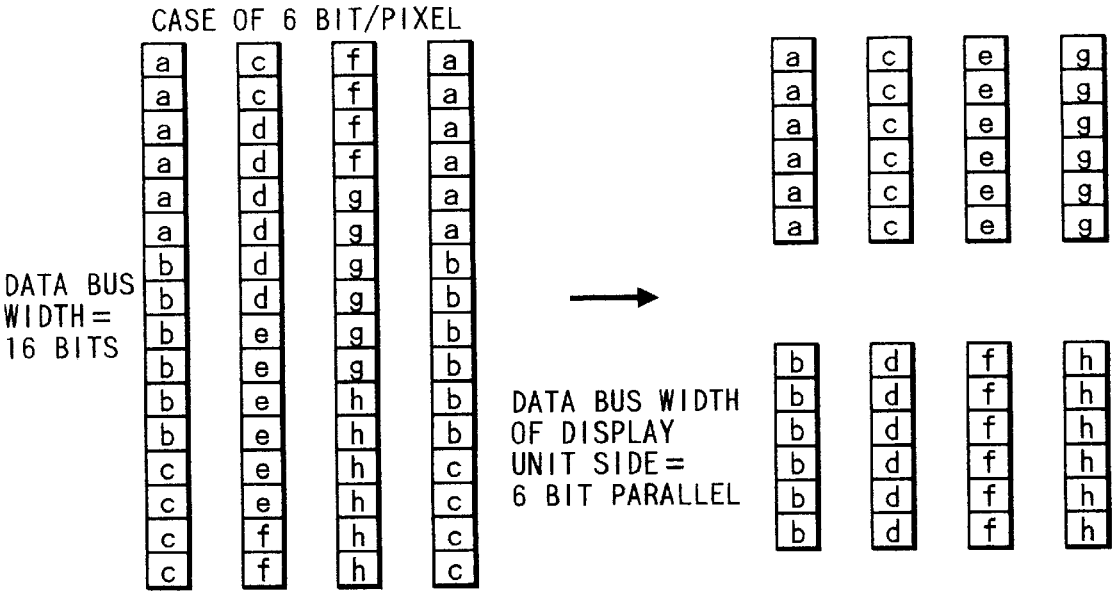
FIGS. 5A and 5B are block diagrams showing a construction of a separation unit and a scanning address data display mode information control unit.
Figure 5B:
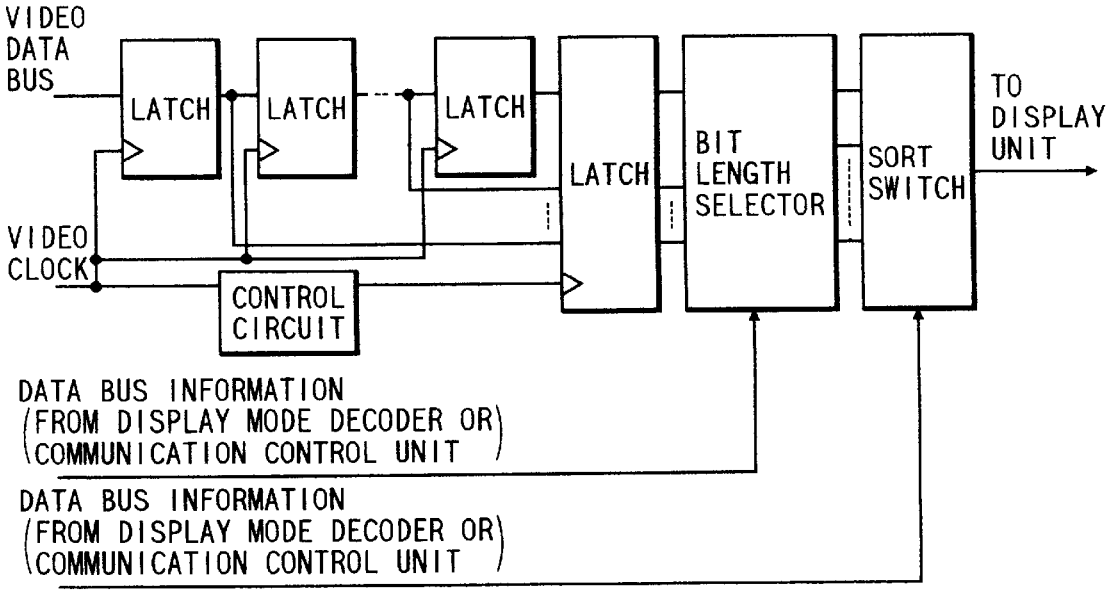

FIGS. 5A and 5B are explanatory diagrams of the sorting operation. The data on the data bus is combined to data in a range from k bits to (k*q) bits by latches of q stages. Only the valid bits among (k*q) bits are sequentially selected by a bit length selector. By constructing as mentioned above, even when the valid data bits differ from the data bus sent, the video data can be continuously inputted to the display unit 300 side. As shown in FIG. 5A, even when the format of bits/pixel on the graphic card 109 side differs from that on the display unit 300, they can be matched.

Further, when the operator wants to sort the data due to a difference of the color matrix on the display unit 300 side, the data sort can be realized by using a sort switch shown in FIG. 5B.

The selecting method of the bit length and sorting method are controlled through the display control unit 205. Therefore, such control can be performed from the graphic card 109 (computer 100).

A data transmission protocol between the graphic card 109 and display controller 200 in the case where power sources of the graphic card 109 and display controller 200 are separately provided will now be described.

Figure 6:
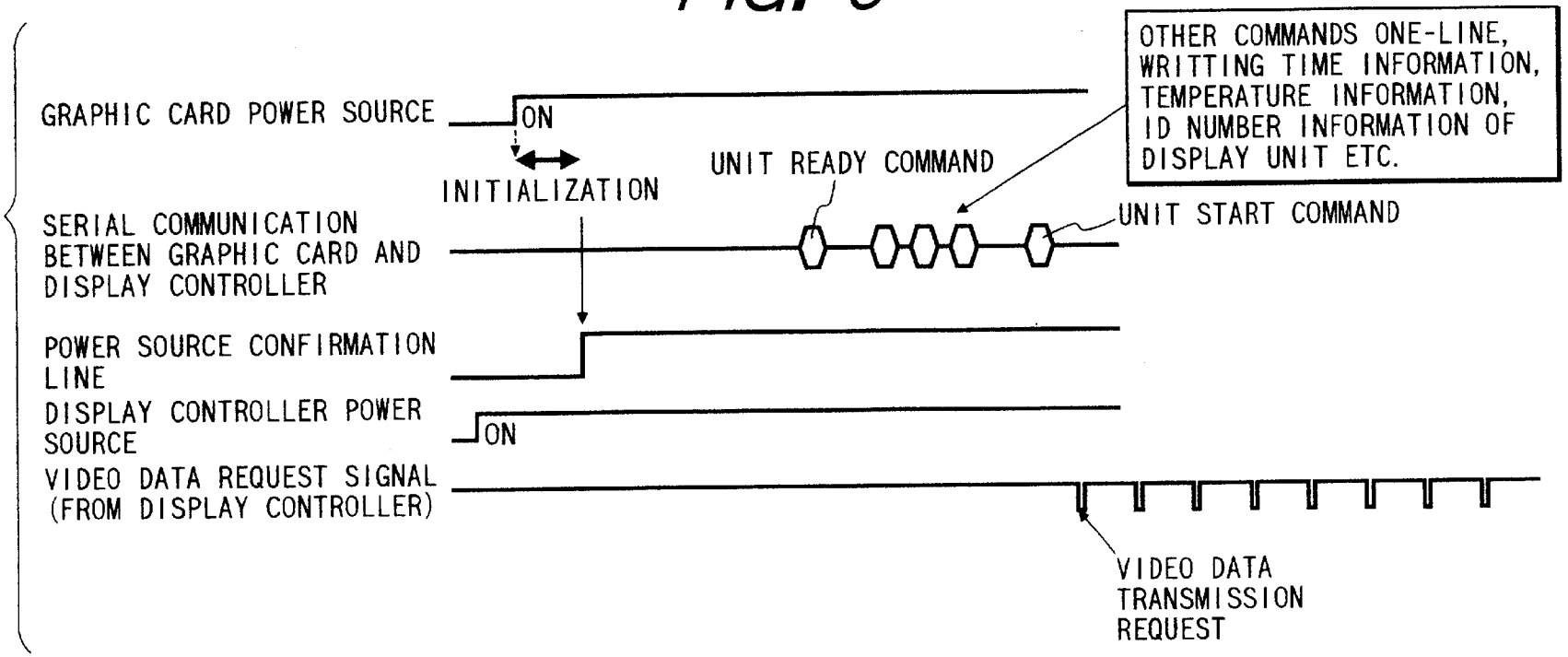
FIG. 6 is a timing chart showing the transmitting operation between a graphic card and a display controller.

FIG. 6 shows a communication protocol between them when the power sources are turned on.

As for the protocol, in addition to a video data transmission bus, an exclusive-use serial communication line (for transmission and reception) and a power source confirmation line of the graphic card 109 are used. This is because it is necessary to construct in a manner such that even if the power source is supplied first to any one of them, the video data can be transmitted and received.

A procedure between the graphic card 109 and display controller 200 when the power source is turned on will now be described.

When the power source is turned on first to the graphic card 109, (1) The graphic card 109 sets the signal on the power source confirmation line to the high (H) level when the power source of the graphic card 109 is turned on and the graphic card side can execute the serial communicating operation.

On the display controller 200 side, the power source confirmation line has been pulled down to the low (L) level through a resistor.

(2) The graphic card 109 monitors the serial communication line and waits until a command of "Unit Ready" is received from the display controller 200.

(3) After the power source is turned on, the display controller 200 first confirms that the power source confirmation line is at the H level.

(4) The display controller 200 transmits the "Unit Ready" command to the graphic card 109 through the serial communication line.

(5) After the graphic card 109 received the "Unit Ready" command, the display controller 200 recognizes that the communication is ready. The graphic card 109 and display controller 200 exchange initial set information.

For example, the display controller 200 transmits an ID number to identify the kind of display unit 300 to the graphic card 109, thereby judging whether or not the connected display unit 300 is suitable for the graphic card 109.

(6) After completion of the initial settings of the graphic card 109 and display controller 200, the graphic card 109 sends a "Unit Start" command to the display controller 200 through the serial communication line.

(7) After receiving the "Unit Start" command, the display controller 200 sends a request signal of the video data to the graphic card 109, successively receives the video data, and enters a normal drawing operation.

Or, after receiving the "Unit Start" command, the display controller 200 can also execute only a preparation to receive the video data that is supplied from the graphic card 109.

The case where the power source is first applied to the display controller 200 will now be described.

(1) After the power source is turned on, the display controller 200 first confirms that the power source confirmation line is at the H level. The display controller 200 waits until the power source confirmation line is set to the H level.

After that, the same procedure as that from the foregoing item (4) is executed.

According to the embodiment as mentioned above, since the video data and the display mode information are multiplexed on the transmission bus and the multiplexed data is transmitted from the graphic card (computer) to the display controller, the state of the display on the display unit can be changed so as to follow a change in display mode on the graphic card side.

In the display controller, as mentioned above, by providing the latches at q stages for inputting the video data transmitted and by selecting the latched video data in accordance with the transmitted display mode information, only the valid data can be extracted irrespective of the data transmission formats on the graphic card side and the display controller side.

Even when the timings to turn on the power sources to the graphic card and display controller are different, the invention can also deal with such a case.

Figure 7:
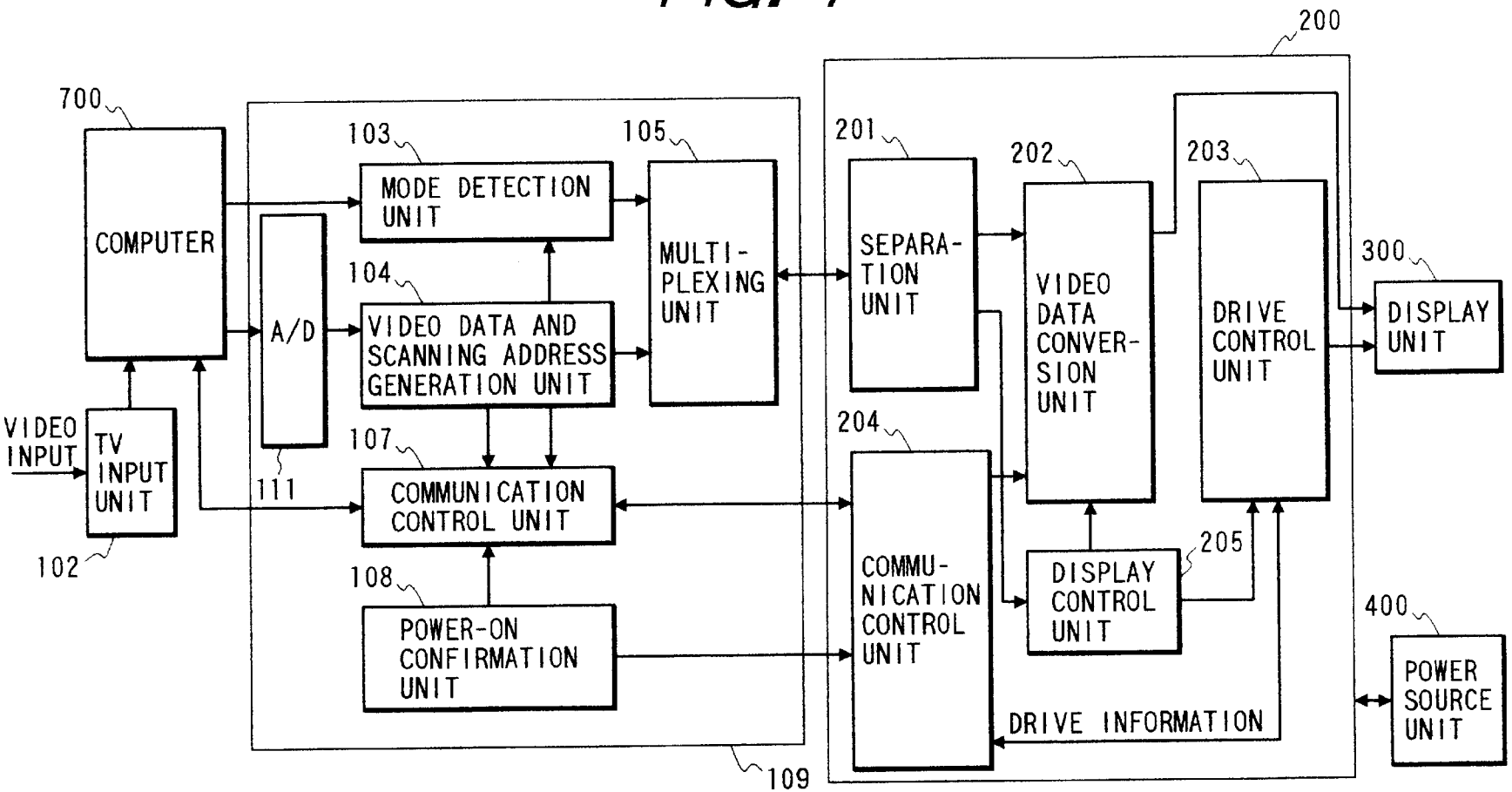
FIG. 7 is a constructional diagram for explaining a construction and operation of a video data conversion unit.

FIG. 7 is a diagram showing another embodiment. In FIG. 7, a computer 700 and the graphic card 109 are separate apparatuses and the computer 700 and graphic card 109 are connected by a connector (not shown).

In FIG. 7, reference numeral 700 denotes the computer including the CPU 101, power source unit 106, operation unit 110, and a bus as in FIG. 1.

Reference numeral 111 denotes an A/D conversion unit for converting analog video data which is supplied from the computer 700 to digital data. The other portions are similar to those in FIG. 1.

In FIG. 7, the mode detection unit 103 detects various modes from horizontal and vertical sync signals which are supplied from the computer 700 and transmits information of them to the display controller 200 in a manner similar to the foregoing embodiment.

When the computer 700 serially transmits the display mode information, it is received by the communication control unit 107 and the display mode information is detected.

As mentioned above, even when the graphic card 109 is not included in the computer, in a manner similar to the foregoing embodiment, in association with a change in display mode, the display controller can promptly follow the mode change.

In FIG. 1, although the mode detection unit 103 and video data and scanning address generation unit 104 have been shown by different circuits, even if a software process is executed by using a memory in which software which executes an operation similar to the operations of those circuits has been stored, a similar effect is obtained.

Many widely different embodiments of the present invention may be constructed without departing from the spirit and scope of the present invention. It should be understood that the present invention is not limited to the specific embodiments described in the specification, except as defined in the appended claims.

What is claimed is:

1. A system which displays an image regarding video data in a plurality of different kinds of display modes comprising:

first generating means for generating the video data;

second generating means for generating mode data which is different from said video data and indicates a display mode of the image regarding said video data generated by said first generating means without using the video data generated by said first generating means;

transmitting means for forming a transmission data train by multiplexing the mode data generated by said second generating means to the video data generated by said first generating means and for transmitting the transmission data train;

processing means for receiving the transmission data train transmitted by said transmitting means and processing said video data in the transmission data train in accordance with said mode data in the transmission data train; and display means for displaying the image regarding the video data processed by said processing means.

2. A system according to claim 1, wherein said transmitting means multiplexes said mode data to said video data so as to transmit said mode data at a predetermined timing for said video data.

3. A system according to claim 2, wherein said second generating means further generates identification data to identify whether the data that is transmitted from said transmitting means is said video data or said mode data, and said transmitting means transmits said identification data at said predetermined timing.

4. A system according to claim 2, further comprising third generating means for generating address data indicative of a position of said video data in one picture plane.

5. A system according to claim 4, wherein said transmitting means transmits said address data of n bits and said mode data of m bits onto a transmission line for transmitting data of k bits (k=n+m) in parallel.

6. A system according to claim 1, wherein said transmitting means multiplexes said mode data to said video data every horizontal sync period.

7. A system according to claim 1, further comprising driving means for driving said display means in accordance with the mode data transmitted by said transmitting means.

8. An apparatus according to claim 1, wherein said transmitting means transmits the transmission data train on a data bus.

9. A video processing apparatus used in a system which displays an image regarding video data in a plurality of different display modes, comprising:

first generating means for generating said video data;

second generating means for generating mode data which is different from said video data and indicates the display mode of the image regarding said video data generated by said first generating means without using the video data generated by said first generating means; and transmitting means for forming a transmission data train by multiplexing the mode data generated by said second generating means to the video data generated by said first generating means and for transmitting the transmission data train to an external processing apparatus, said external processing apparatus converting said video data in the transmission data train into data of a form suitable for display according to the mode data in the transmission data train.

10. An apparatus according to claim 9, wherein said transmitting means multiplexes said mode data to said video data so as to transmit said mode data at a predetermined timing for said video data.

11. An apparatus according to claim 10, wherein said second generating means further generates identification data to identify whether the data that is transmitted from said transmitting means is said video data or said mode data, and said transmitting means transmits said identification data at said predetermined timing.

12. An apparatus according to claim 11, further comprising third generating means for generating address data indicative of a position of said video data in one picture plane, and said transmitting means further also transmits said address data.

13. An apparatus according to claim 9, wherein said transmitting means multiplexes said mode data to said video data every horizontal sync period.

14. An apparatus according to claims 9, further comprising setting means for setting a display mode of said video data, and wherein said second generating means generates said mode data in accordance with an output of said setting means.

15. An apparatus according to claim 9, wherein said transmitting means transmits said address data of n bits and said mode data of m bits onto a transmission line for transmitting data of k bits (k=n+m) in parallel.

16. An apparatus according to claim 9, wherein said transmitting means transmits the transmission data train on a data bus.

17. A video data processing apparatus used in a system which displays an image regarding video data in a plurality of display modes, comprising:

receiving means for receiving a transmission data train formed by multiplexing said video data and mode data generated without using the video data which is different from said video data and indicates a display mode of said video data;

processing means for processing said video data in the transmission data train on a basis of said mode data in the transmission data train; and output means for outputting said video data processed by said processing means to a display device which displays an image regarding said processed video data.

18. An apparatus according to claim 17, wherein said processing means changes the number of samples in said video data in accordance with said mode data.

19. An apparatus according to claim 17, further comprising control means for controlling a display operation of said display device in accordance with said mode data.

20. An apparatus according to claim 19, wherein said control means changes the number of lines which are simultaneously driven in said display device in accordance with said mode data.

21. An apparatus according to claim 17, wherein said receiving means receives said mode data of m bits ($m \leqq k$) transmitted onto a transmission line for transmitting data of k bits in parallel.

22. A video data processing apparatus used in a system which displays an image regarding video data in a plurality if display modes and for outputting video data to a controller to control a driving of a display device to display graphics, wherein mode data which is different from said video data and indicates a display mode of the graphics in said display device are generated without using the video data and are multiplexed to said video data and said multiplexed video data and mode data are transmitted onto a common transmission line.

23. An apparatus according to claim 22, wherein said transmission line is a line for transmitting data of k bits in parallel and transmits said mode data of m bits ($m \leqq k$) onto said transmission line.

24. A video data processing apparatus used in a system which displays an image regarding video data in a plurality of display modes, comprising:

input means for inputting said video data;

generating means for generating mode data which is different from said video data and indicates a display mode on the image regarding said video data without using the video data input by said input means; and transmitting means for multiplexing said mode data generated by said generating means to said video data inputted by said input means and transmitting the multiplexed video data and mode data a common transmission line for transmitting data of k bits in parallel.

25. An apparatus according to claim 24, wherein said transmitting means multiplexes said mode data to said video data every horizontal sync period.

26. An apparatus according to claim 17, wherein said receiving means receives the transmission data train through a data bus.

* * * * *

UNITED STATES PATENT AND TRADEMARK OFFICE

CERTIFICATE OF CORRECTION

PATENT NO. : 6,232,951 B1
DATED : May 15, 2001
INVENTOR(S) : Katsuhiro Miyamoto

It is certified that error appears in the above-identified patent and that said Letters Patent is hereby corrected as shown below:

Column 1,
Line 10, "2," should read -- 2. --.

Column 10,
Line 32, "if" should read -- of --.

Signed and Sealed this

Twelfth Day of March, 2002

*Attest:*

*Attesting Officer*

JAMES E. ROGAN
*Director of the United States Patent and Trademark Office*